United States Patent [19]

Lucke

[11] 4,177,957

[45] Dec. 11, 1979

[54] APPARATUS FOR CLAMPING A THREAD

[75] Inventor: Florian Lucke, Mengen, Fed. Rep. of Germany

[73] Assignee: Lucke Apparate-Bau Gesellschaft mit beschraenkter Haftung, Mengen, Fed. Rep. of Germany

[21] Appl. No.: 937,888

[22] Filed: Aug. 29, 1978

[30] Foreign Application Priority Data

Sep. 2, 1977 [DE] Fed. Rep. of Germany ..... 2739535

[51] Int. Cl.[2] ..... B65H 54/56; B65H 49/30

[52] U.S. Cl. ..... 242/53; 28/291; 242/125.1; 242/127

[58] Field of Search ..... 242/53, 18 R, 35.5 R, 242/41, 35.5 A, 127, 110, 110.1, 110.2, 125, 125.1; 28/291

[56] References Cited

U.S. PATENT DOCUMENTS

| | | | |
|---|---|---|---|
| 1,068,847 | 7/1913 | Berthold | 242/53 X |
| 1,360,018 | 11/1920 | Rasmussen | 242/53 |
| 1,631,893 | 6/1927 | Schenck, Sr. | 242/53 X |
| 1,838,813 | 12/1931 | Drake | 242/53 |
| 2,545,212 | 3/1951 | Ruf | 242/53 |

FOREIGN PATENT DOCUMENTS

| | | | |
|---|---|---|---|
| 22329 | 12/1966 | Japan | 242/53 |
| 25866 | 8/1970 | Japan | 242/53 |
| 1205818 | 9/1970 | United Kingdom | 242/53 |
| 1206570 | 9/1970 | United Kingdom | 242/53 |

*Primary Examiner*—Stanley N. Gilreath

*Attorney, Agent, or Firm*—A. C. Nolte, Jr.; Edward B. Hunter

[57] ABSTRACT

Apparatus for clamping a thread in a reeling machine having a reeling cage which is rotatably mounted on the machine frame and comprises bars extending parallel to the axis of rotation thereof, and a thread laying device which is displaceable on the machine frame, for changing laying of an incoming thread in rope form on the bars of the reeling cage, wherein at least one bar of the reeling cage is provided with a strip-like-first brush for clamping a thread between its bristles, and a thread receiver which is displaceable backwards and forwards on the machine frame transversely to the axis of rotation of the reeling cage supports a similar second brush, and wherein a certain thread length can be pulled out by means of an arm which is pivotally mounted on the thread receiver between the second brush advanced together with the thread receiver and the thread laying device, which thread length, after the thread has been severed, the finished rope has been removed and the thread receiver has returned, hangs in the path of the first brush and is clampable by the latter.

6 Claims, 7 Drawing Figures

APPARATUS FOR CLAMPING A THREAD

This invention relates to apparatus for clamping a thread in a reeling machine having a reeling cage which is rotatably mounted on the machine frame and comprises bars extending parallel to the axis of rotation thereof, and having a thread laying device which is displaceable on the machine frame for changing laying of an incoming thread in the form of a rope on the bars of the reeling cage.

In known reeling machines the difficulty exists that after a rope has been finished and the incoming thread has been severed, the thread end which is required for tying the rope together drops down and must first be recovered again, which is to a troublesome operation. Furthermore, the start of the thread produced upon severing for the new rope must be connected by hand to the reeling cage, which is also a troublesome operation.

It is an object of the present invention to provide auxiliary apparatus for reeling machines by means of which the thread end and the thread start of the severed incoming thread can be clamped automatically to the machine.

The present invention provides apparatus for clamping a thread in a reeling machine, comprising a reeling cage which is rotatably mounted on a machine frame and comprises bars extending parallel to the axis of rotation thereof, and a thread laying device which is displaceable on the machine frame, for changing laying of an incoming thread in rope form on the bars of the reeling cage, a strip-like first brush for clamping a thread between its bristles provided on at least one bar of the reeling cage and extending in the longitudinal direction thereof, a thread receiver which is displaceable backwards and forwards on the machine frame transversely to the axis of rotation of the reeling cage, a second said brush supported by the thread receiver, and an arm which is pivotally mounted on the thread receiver for pulling out a certain thread length between the second brush advanced together with the thread receiver and the thread laying device, which thread length, after the thread has been severed between the second brush and the laying device, the finished rope has been removed and the thread receiver has returned, hangs in the path of the first brush and is clampable by the latter.

The invention will be further described, by way of example only, with reference to the accompanying drawings, in which.

Figure 1:
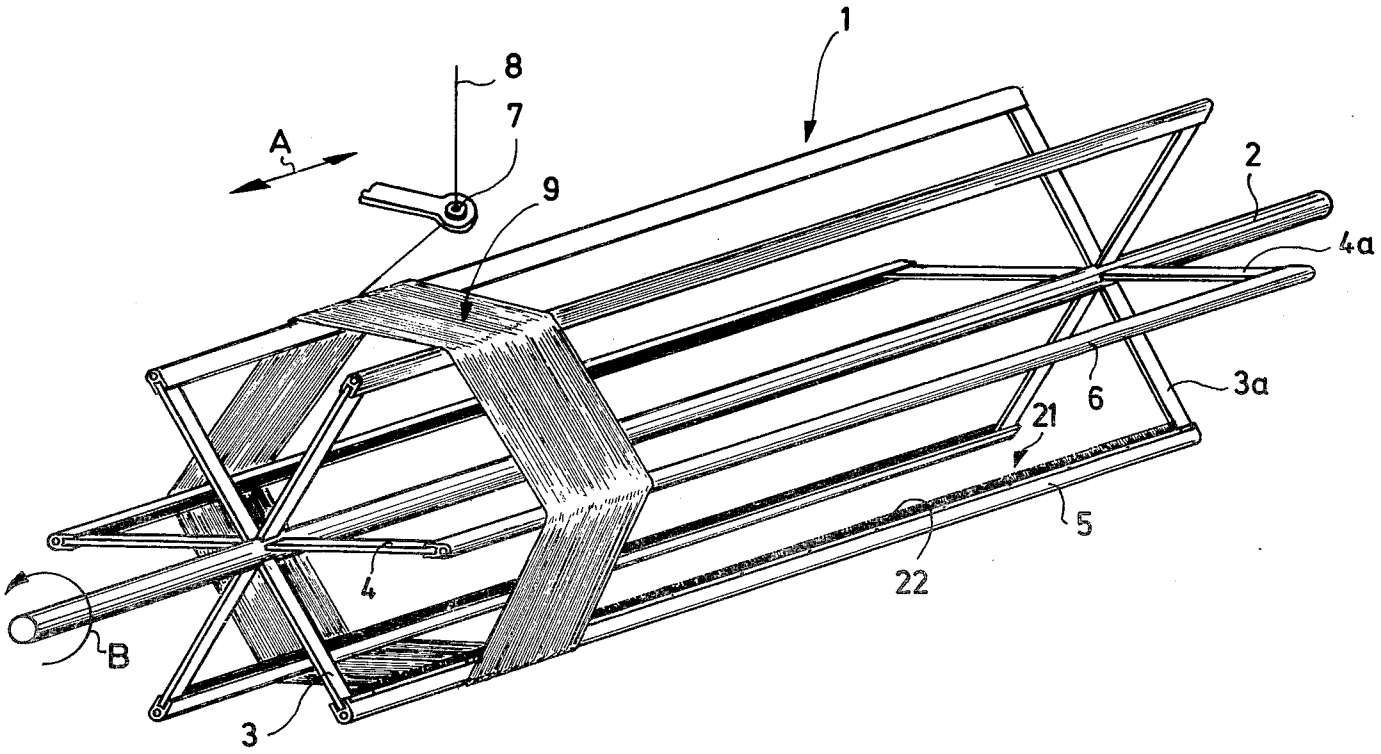
FIG. 1 is a perspective view of the reeling cage of a reeling machine with the thread guide of a laying device.

FIG. 1 illustates semi-diagrammatically the reeling cage 1 of a conventional reeling machine. The reeling cage 1 comprises a shaft 2 which is rotatably mounted in bearings of a machine frame (not illustrated in FIG. 1) and from which extend radially at intervals respective spokes, e.g. 3, 3*a* and 4, 4*a*. The ends of the spokes are connected by respective bars, e.g. 5 and 6, which extend parallel to the shaft 2. Furthermore the machine frame is provided with a thread laying device (not illustrated in FIG. 1) which is reciprocable parallel to the shaft 2 in the direction of the arrow A. A thread guide 7 in the form of an eyelet projects from the laying device and a thread 8 extends therethrough in its travel from a storage reel to the reeling cage 1. The thread 8 is wound over the bars of the reeling cage 1 to form a preferably multiple layer rope 9. During the reeling process the motor-driven reeling cage 1 rotates in the direction of the arrow B, while the thread guide 7 is reciprocated in the direction of the arrow A in accordance with the width of the rope 9. After the rope 9 has been finished it is tied together and pushed laterally off the reeling cage, for which purpose the cage may be constructed to be collapsible in a conventional manner. Usually a plurality of ropes 9 are wound simultaneously side by side on a single reeling cage 1, for which purpose a pluralilty of laying devices with thread guides 7 are provided one beside the other.

Prior to commencing the reeling process, the start of the incoming thread 8 must first be attached to a bar of the reeling cage 1. After termination of the reeling process the thread 8 must be severed, the thread end produced thereby being used for tying the rope 9 together and the thread start produced thereby being connected again to a bar of the reeling cage, as the start of the next following rope. As mentioned above, recovering the thread end and connection of the thread start to the bar are time-consuming operations which are to be rendered automatic to a large extent by the apparatus proposed herein.

Figure 2:
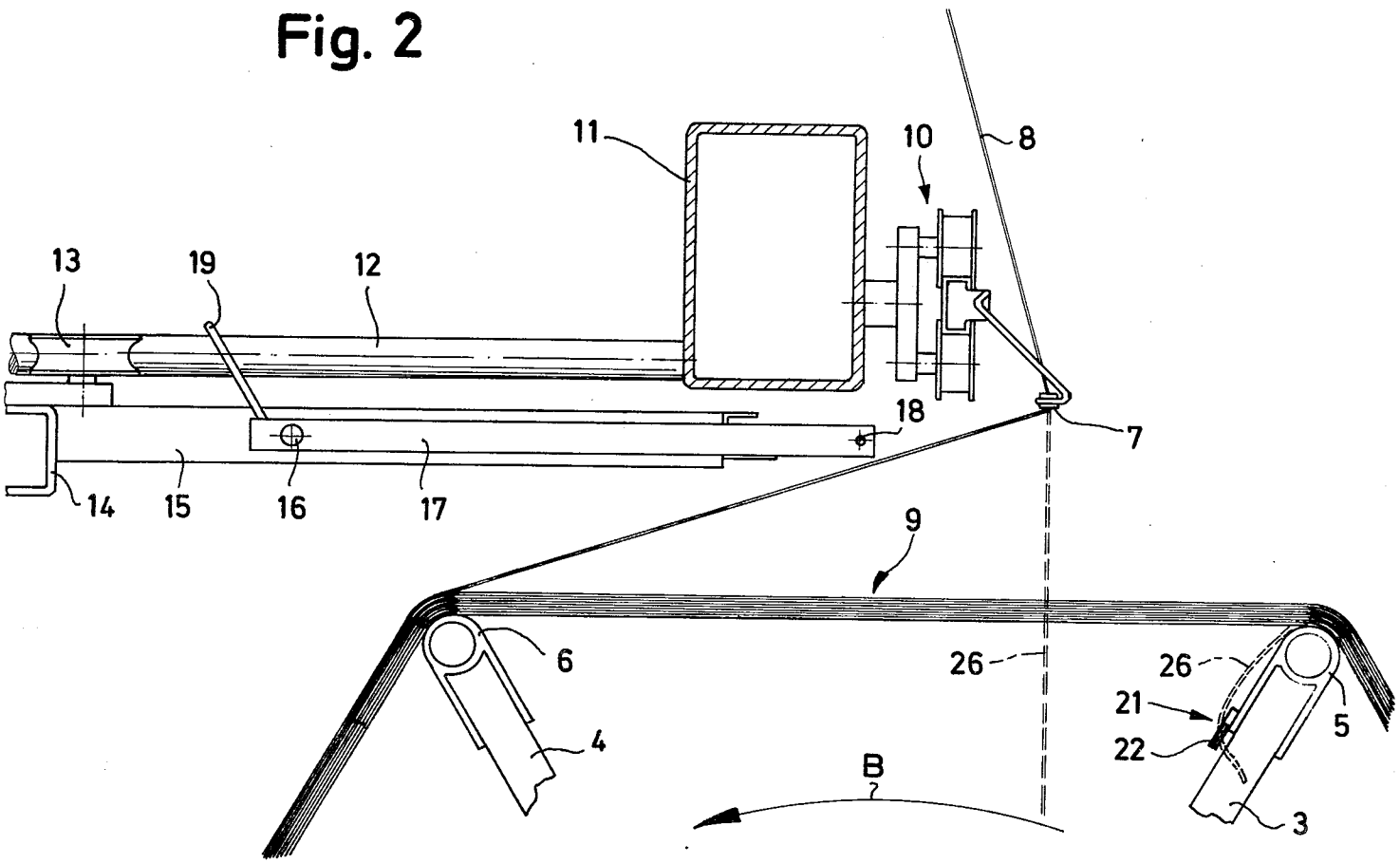
FIG.2 is a partly sectional view of apparatus for clampingly attaching the thread in a first operational phase.

FIG. 2 illustrates diagrammatically a sectional view of apparatus for clampingly attaching a thread in reeling machines. In FIG. 1, merely the two spokes 3 and 4 and the bars 5 and 6 of the reeling cage 1 illustrated therein are indicated. The shaft 2 of the reeling cage extends perpendicularly to the plane of the drawing of FIG. 2.

The thread laying device 10 with the thread guide 7 is reciprocably mounted on a support beam 11 of the machine frame; the beam is constructed as a hollow profile and extends parallel to the shaft 2 of the reeling cage. A drive (not illustrated) ensures the reciprocatory movement of the thread guide. A carriage 14 is displaceably mounted by means of rollers 13 on a horizontally extending guide rail 12, a thread receiver 15 projecting from the carriage 14 in cantilever fashion. An arm 17 pivotal about an axis 16 is mounted on the thread receiver 15. The arm 17 has a rod 18 (see FIG. 5) extending parallel to the shaft 2 of the reeling cage. A pin 19 projects obliquely backwards from the arm 17, and upon forward displacement of the carriage 14 in the direction of the thread guide 17 the pin 19 abuts the support beam 11 and effects upward swinging of the arm 17 with the rod 18. For the purpose of reciprocating the carriage 14, the same may be connected to a driving motor (not illustrated).

Figure 3:
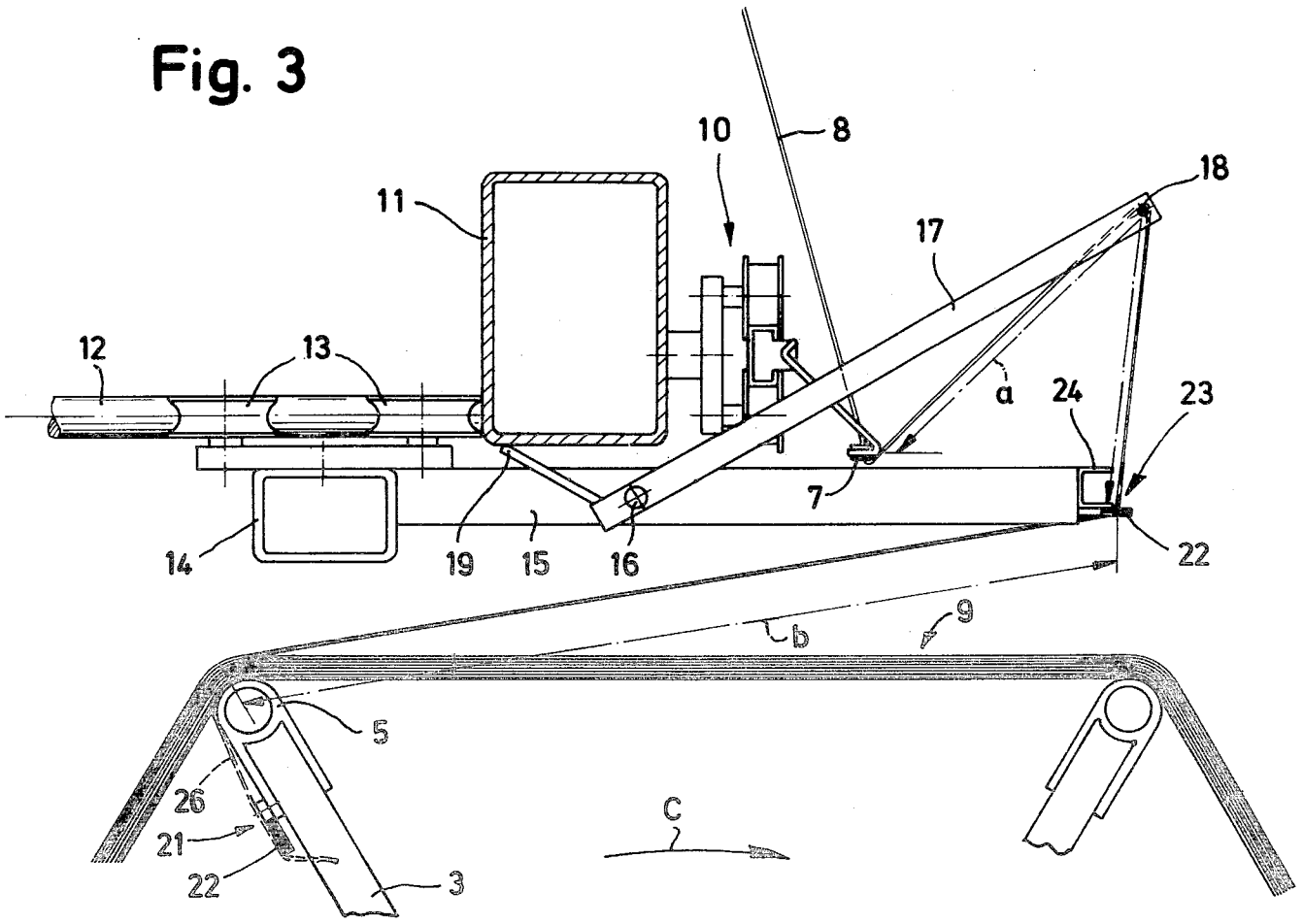
FIG. 3 is a view similar to FIG. 2 showing the apparatus in the next-following operational phase.
Figure 5:
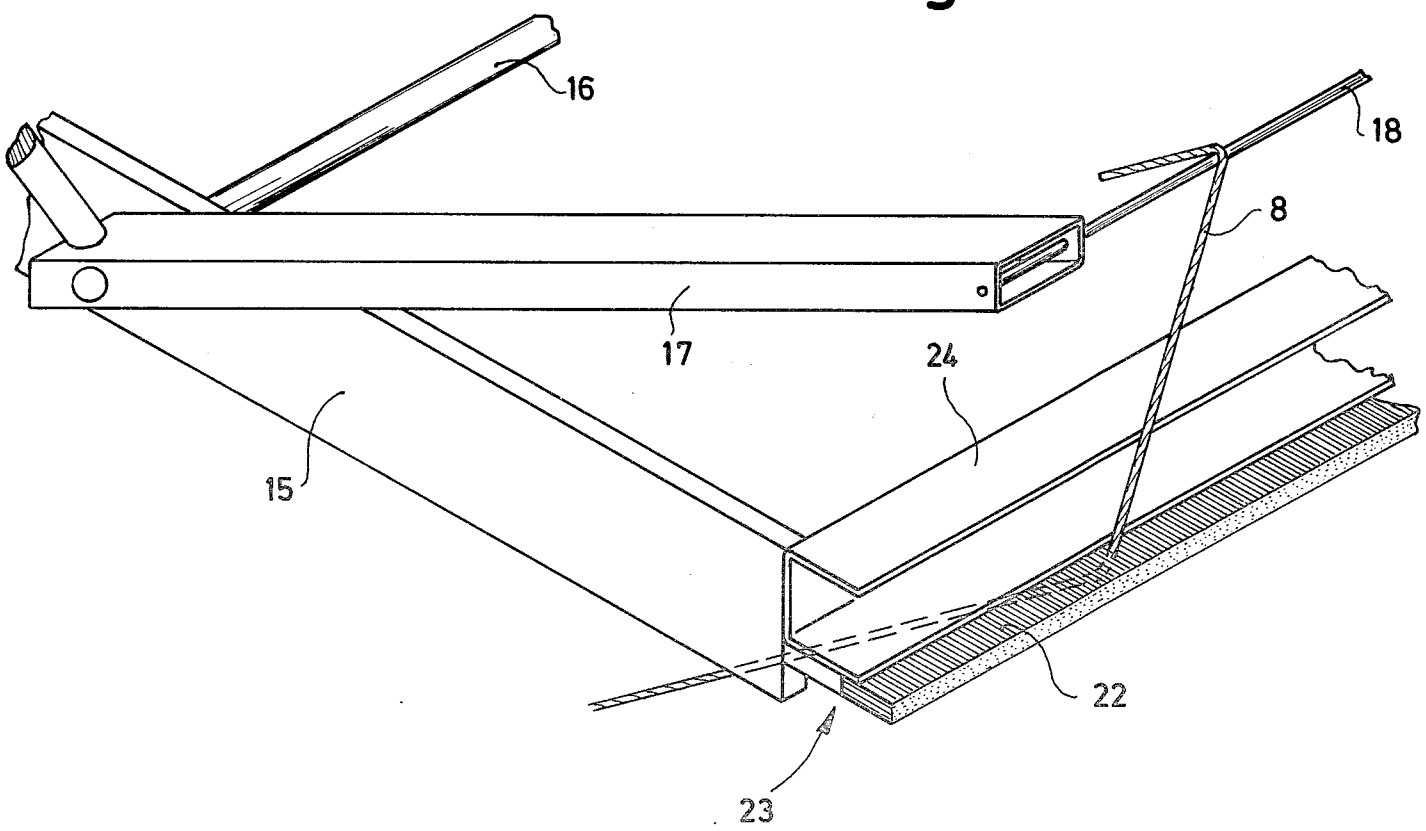
FIG. 5 is a perspective view of a thread clamped in a brush.
Figure 6:
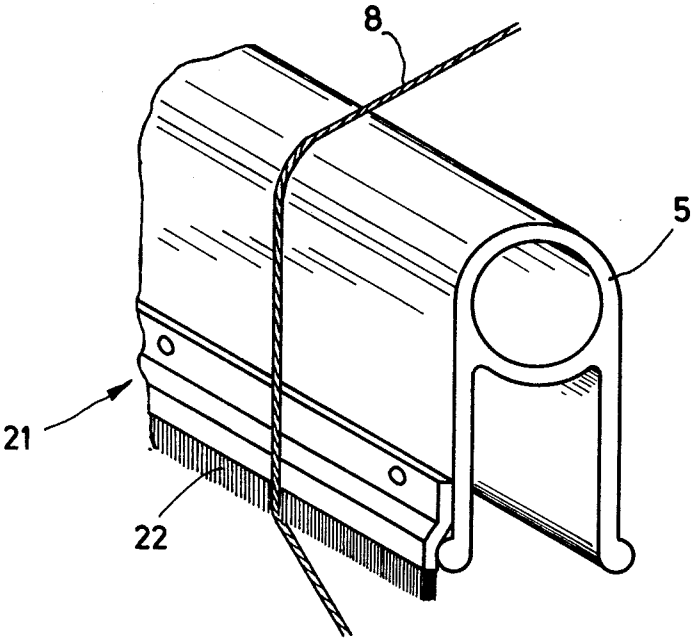
FIG. 6 is a perspective view of a brush arranged on a bar of the reeling cage for clampingly attaching the thread; and, FIG. 7 is a partly sectional diagrammatic view showing apparatus for clamping a thread in a reeling machine with a laying roller.

As is clear in particular from FIG. 6, a first strip-like brush 21 having bristles 22 which extend substantially parallel to the spoke 3 (FIG. 2) is fixed to the bar 5 and extends parallel to the longitudinal axis thereof. The brush 21 extends substantially over the entire longitudinal extent of the bar 5 under all ropes 9 wound upon the reeling cage. A second brush 23 (see FIGS. 3 and 5) is attached to the forward end of the thread receiver 15 below the lower limb of a rail 24 of U-shaped cross-section. The brush 23 and the rail 24 extend likewise subtantially over the entire length of the reeling cage 1. The rail 24 serves as a cutting rail in a manner still to be described.

The apparatus described above operates in the following manner. During the winding of the rope 9 the carriage 14 with the thread receiver 15 and the arm 17 remains in the position illustrated in FIG. 2. The thread 8 travels through the thread guide 7 which is moved reciprocatingly by the laying device 10 and upon the bars 5,6 of the reeling cage. After the termination of the reeling process the reeling cage 1 is stopped in the position illustrated in FIG. 3; in this position the bar 5 which supports the brush 21 comes to rest at the upper side of the reeling cage displayed by approximately 30° in an anti-clockwise direction relative to the vertical. Thereafter the carriage 14 with the thread receiver 15 is advanced by its driving motor, or preferably even manually, until the arm 17 is swung upwards by the abutment of the pin 19 against the support beam 11. In the end position of the arm 17, the incoming thread extends from the thread guide 7 over the rod 18 between the bristles 22 of the brush 23 where it is clamped, to the bar 5. The thread extending between the thread guide 7 over the rod 18 to the brush 23 bridges a cranked path portion which is indicated by a dash-dotted line a in FIG. 3.

Figure 4:
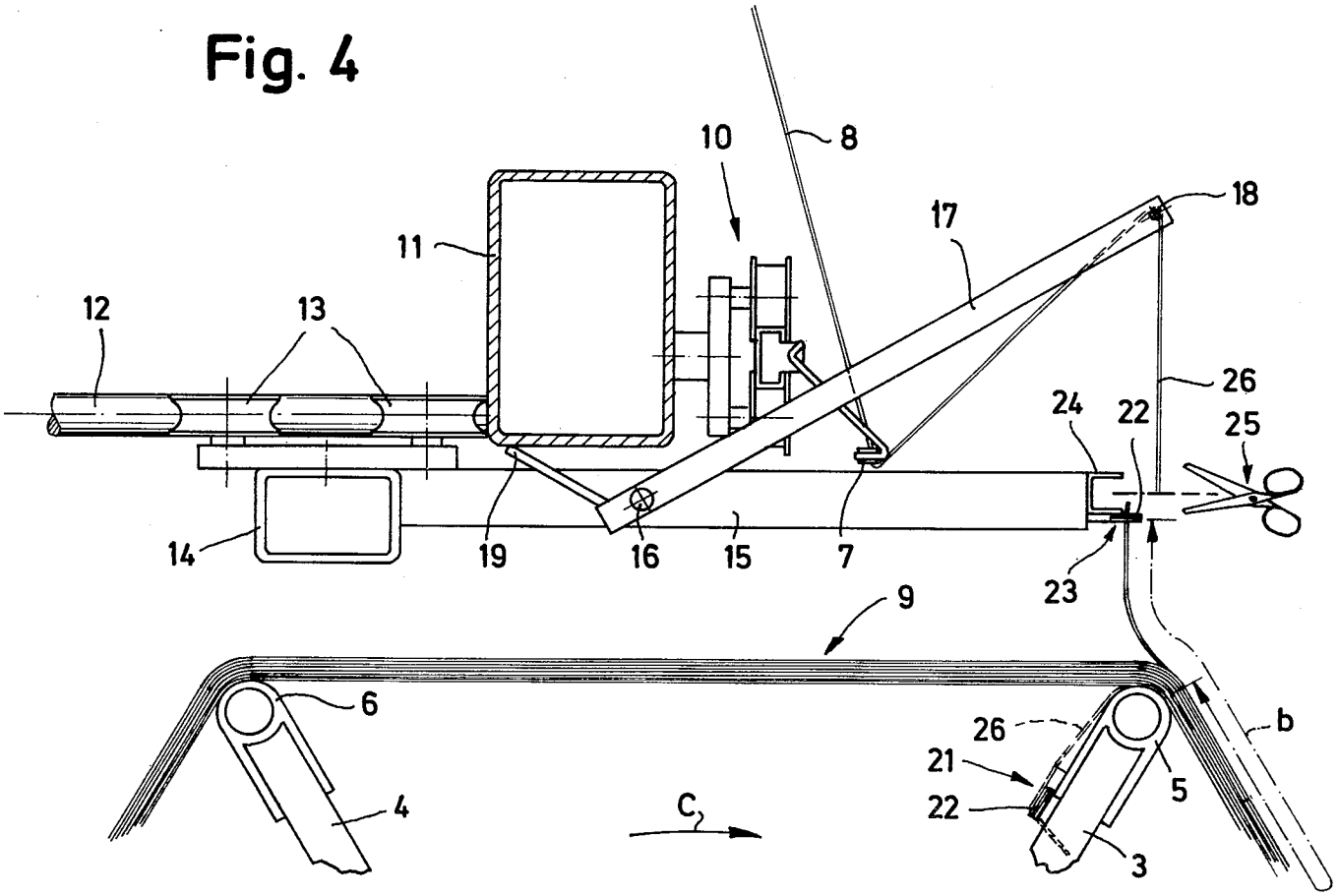
FIG.4 is a view similar to FIGS. 2 and 3 showing the apparatus after severance of the incoming thread.

Between the brush 23 and the bar 5 the thread extends through a path portion b. The path of the incoming thread 8 has been lengthened relative to the state illustrated in FIG. 2 by approximately the path a, owing to the forward displacement of the thread receiver 15 and the upward rotation of the arm 17. Thereupon the reeling cage is turned back through approximately 60° in the direction of the arrow C, until the bar 5 assumes the position illustrated in FIG. 4, which otherwise corresponds to the position according to FIG. 2. Thereby a free loop is produced from the thread length bridging the path portion b, the loop being indicated by dash-dotted line in FIG. 4 and likewise denoted by the letter b. The end of this loop is located in the brush 23.

The thread 8 is then severed in the region between the limbs of the rail 24, and this may be effected manually by means of a pair of scissors 25, or alternatively by means of an automatic known cutting device which is provided on the reeling machine. The thread end fixed by the brush 23 is then conveniently gripped by an operator and used for tying the rope 9. Subsequently the tied rope is removed from the reeling cage 1. In order to connect the thread start which is denoted by Numeral 26 in FIG. 4 and which extends over the path portion a (FIG. 3) to the reeling cage again for winding the next following rope, the carriage 14 is then pushed back until the pin 19 is free of the support beam 11, whereby the arm 17 assumes its horizontal starting position again in accordance with FIG. 2. Thereby the thread start 26 previously extending over the path portion a places itself on the reeling cage relieved of the preceding rope 9 and into the travelling path of the bar 5, as is illustrated by broken lines in FIG. 2.

When the reeling cage is then set in rotary motion again in the direction of the arrow B, this usually occurring at a relatively high starting speed, the strip-like brush 21 attached to the bar 5 grips the thread start 26 and retains it securely clamped between its bristles, so that the next rope 9 is wound automatically on the reeling cage. Thus manually clamping the thread beginning 26 as was the case heretofore is no longer necessary. Moreover the thread start of the preceding rope 9 securely clamped by the brush 21 is illustrated by broken lines in FIGS. 2 to 4. The retention of the thread 8 by the brushes 21 and 23 is illustrated in FIGS. 5 and 6 on an enlarged scale.

Figure 7:
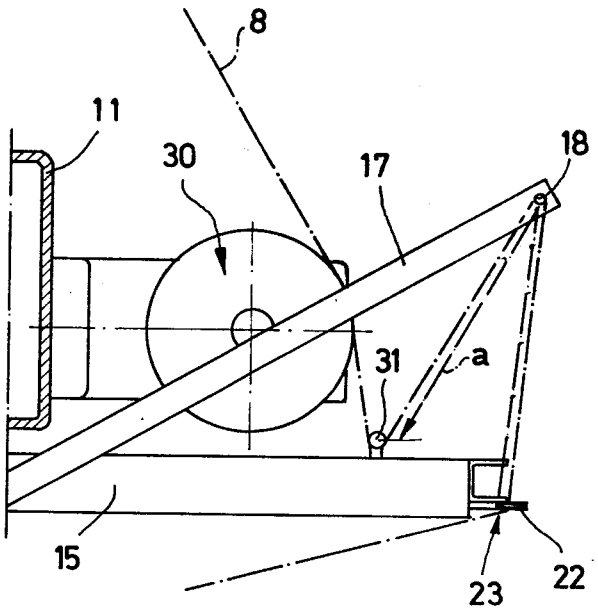

In the embodiment of the invention described so far, the reciprocating thread guide 7 serves for changing laying of the thread. In place of such a thread guide, alternatively there may be used a conventional laying roller which is provided with crossing grooves in a known manner in which the thread is reciprocated over the width of the rope during the rotation of the roller. Such a laying roller 30 is illustrated diagrammatically in FIG. 7 and is mounted on the support beam 11 of the machine frame, in the same way as the laying device 10 in FIGS. 2 to 4. In order to obtain in such a laying roller 30 the thread length a required for reconnection of the thread start to the reeling cage, the thread receiver 15 is provided with a diverter rod 31 which extends rigidly parallel to the rod 18 and around which the thread 8 travels. The thread length required for the new thread start is pulled out between this diverter rod 31 and the brush 23.

The processes described above may be controlled automatically, e.g. by electrical switching means, without difficulty, a control circuit of a known kind initiating and stopping always at the right instant of time the synchronized movement of the reeling cage 1, the arm 15, a mechanical cutting device, and so forth.

I claim :

1. Apparatus for clamping a thread in a reeling machine, comprising a reeling cage which is rotatably mounted on a machine frame and comprises bars extending parallel to the axis of rotation thereof, and a thread laying device which is displaceable on the machine frame for laying of an incoming thread on the bars of the reeling cage, a strip-like first brush for clamping a thread between its bristles provided on at least one bar of the reeling cage and extending in the longitudinal direction thereof, a thread receiver which is displaceable between retracted and advanced positions on the machine frame transversely to the axis of rotation of the reeling cage, a second strip-like brush supported by the thread receiver for clamping the thread between the thread laying device and the reeling cage when the thread receiver is displaced to its advanced position, and an arm pivotally mounted on the thread receiver for pulling out a certain thread length between the second brush and the thread laying device when the thread receiver is displaced to its advanced position, which thread length, after the thread has been severed between the second brush and the laying device, the reeled thread has been removed and the thread receiver has been displaced to its retracted position, hangs in the path of the first brush and is clampable by the latter.

2. Apparatus according to claim 1, wherein the bristles of the first brush are directed radially towards the axis of rotation of the reeling cage.

3. Apparatus according to claim 1, wherein the bristles of the second brush are directed substantially horizontally when the thread receiver is displaced to is advanced position.

4. Apparatus according to claim 1, wherein said arm is privotal by a pin which impinges on the machine frame when the thread receiver is displaced to its advanced position.

5. Apparatus according to claim 1, wherein the second brush is associated with a rail of U-shaped cross-section between the limbs of which the thread may be severed.

6. Apparatus according to claim 1, wherein the thread laying device is constructed in the form of a grooved roller, and wherein a diverter rod is provided which extends parallel to the laying direction and by means of which the thread can be pulled out.

* * * * *

UNITED STATES PATENT AND TRADEMARK OFFICE

CERTIFICATE OF CORRECTION

PATENT NO. : 4,177,957

DATED : 12/11/79

INVENTOR(S) : LUCKE, FLORIAN

It is certified that error appears in the above-identified patent and that said Letters Patent are hereby corrected as shown below:

Column 4, lines 65-68 should read:

3.Apparatus according to claim 1, wherein the bristles of the second brush are directed substantially horizontally when the thread receiver is displaced to [is] <u>its</u> advanced position.

Signed and Sealed this

*Twenty-fifth* Day of *March 1980*

[SEAL]

*Attest:*

SIDNEY A. DIAMOND

*Attesting Officer* *Commissioner of Patents and Trademarks*